US008726853B2

(12) United States Patent
Ortlepp et al.

(10) Patent No.: US 8,726,853 B2
(45) Date of Patent: May 20, 2014

(54) FUEL SUPPLY SYSTEM

(71) Applicant: Daimler AG, Stuttgart (DE)

(72) Inventors: Thorsten Ortlepp, Weinstadt-Grossheppach (DE); Christian Grunenberg, Kernen (DE); Emmanuel Routier, Stuttgart (DE)

(73) Assignee: Daimler AG, Stuttgart (DE)

( * ) Notice: Subject to any disclaimer, the term of this patent is extended or adjusted under 35 U.S.C. 154(b) by 0 days.

(21) Appl. No.: 13/621,252

(22) Filed: Sep. 16, 2012

(65) Prior Publication Data

US 2013/0048754 A1 Feb. 28, 2013

Related U.S. Application Data

(63) Continuation of application No. PCT/EP2010/007516, filed on Dec. 9, 2010.

(30) Foreign Application Priority Data

Mar. 18, 2010 (DE) ..... 10 2010 011 915

(51) Int. Cl.
*F02M 37/22* (2006.01)

(52) U.S. Cl.
CPC ..... *F02M 37/221* (2013.01)
USPC ..... 123/25 J; 123/25 A

(58) Field of Classification Search
CPC ..... F02M 37/221; F02M 37/22
USPC ..... 123/25 R, 25 A, 25 J; 210/109, 114, 309, 210/416.4, 416.1, 513; 60/286, 274
See application file for complete search history.

(56) References Cited

U.S. PATENT DOCUMENTS

| | | | | |
|---|---|---|---|---|
| 4,637,351 | A * | 1/1987 | Pakula | 123/25 J |
| 5,053,120 | A * | 10/1991 | Mollmann | 210/86 |
| 2006/0277899 | A1 * | 12/2006 | Ruona | 60/286 |
| 2007/0114160 | A1 * | 5/2007 | Giolitti et al. | 210/86 |

FOREIGN PATENT DOCUMENTS

| | | |
|---|---|---|
| DE | 10 2006 027 201 | 12/2006 |
| EP | 0 777 046 | 6/1997 |
| WO | WO 83/01210 | 4/1983 |
| WO | WO 2006/034889 | 4/2006 |
| WO | WO 2009/059102 A2 | 5/2009 |

* cited by examiner

*Primary Examiner* — Mahmoud Gimie
(74) *Attorney, Agent, or Firm* — Klaus J. Bach

(57) ABSTRACT

In a fuel supply system with a fuel supply pipe for pumping fuel from a fuel tank via a fuel supply pipe to a fuel injection device of an internal combustion engine, wherein a fuel filter including a water separator is arranged in the fuel supply pipe for removing water collected in the water separator and injecting it into an exhaust gas system, a fuel/water discharge arrangement is provided which includes a main pipe connected to the fuel filter, a branch pipe connected to a water collection region of the fuel filter and a mixing device arranged in the main pipe for mixing water to a fuel flow in the main pipe for injection into the exhaust gas system.

6 Claims, 1 Drawing Sheet

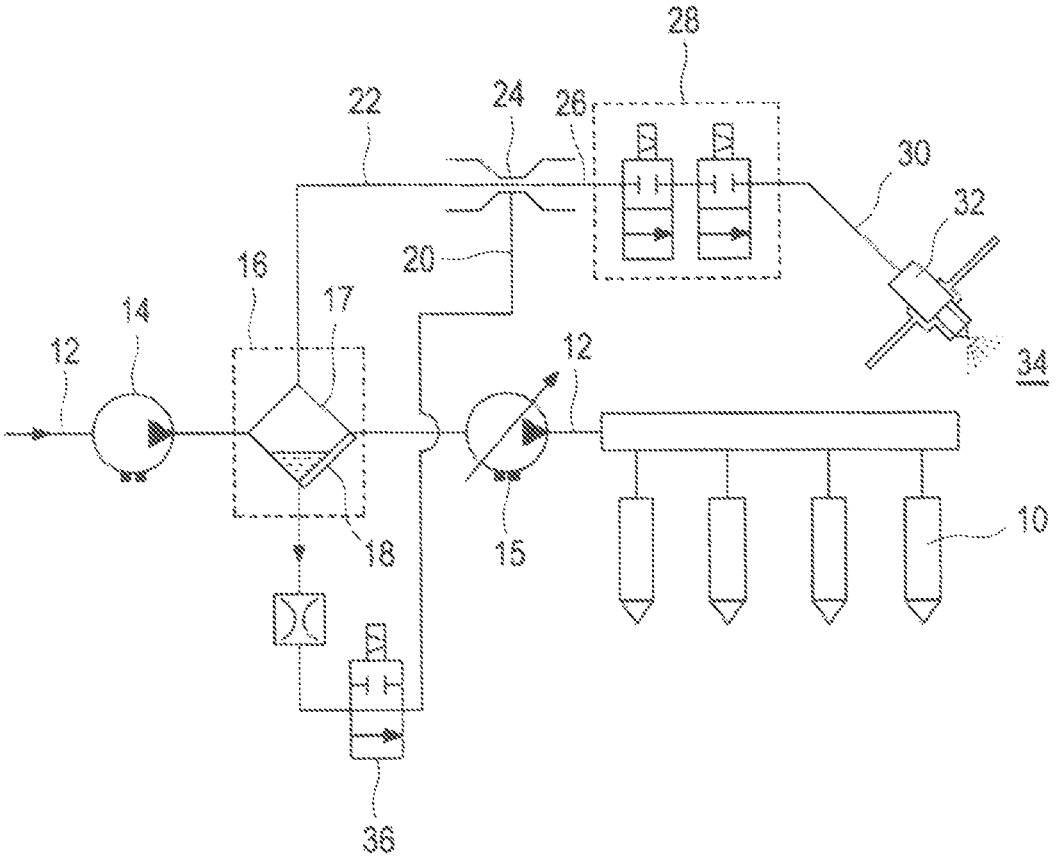
28
22
24
26
30
32
20
16
17
14
12
12
34
18
15
10
36

FUEL SUPPLY SYSTEM

This is a Continuation-In-Part application of pending international patent application PCT/EP2010/007516 filed Dec. 9, 2010 and claiming the priority of German patent application 10 2010 011 915.6 filed Mar. 18, 2010.

BACKGROUND OF THE INVENTION

The invention relates to a fuel supply system for an internal combustion engine with a fuel supply line extending from a fuel tank to a fuel injection device of the internal combustion engine and including a water separator and water discharge arrangement for discharging the water into the engine exhaust system.

The use of fuel filters with water separators in the fuel supply pipe to the fuel injection device of an internal combustion engine has been known for a long time. The water must thereby be regularly emptied from the fuel filter or the water separator. A problem here is that the water separated in the fuel filter is generally contaminated with fuel. Since non-combusted fuel may not be discharged into the environment, high-resource and costly water filters or treatment systems for example must be used for the disposal of the collected water.

DE 195 45 133 A1 discloses a fuel filter with a fuel inlet for the unpurified fuel and a fuel outlet for the purified fuel. Furthermore a water separator is integrated into the fuel filter, the water removal means of which is coupled with the fuel outlet. In order to mix a defined portion of fuel back into the separated water flow the removal pipe of the water separator is coupled with the fuel pipe connected to the fuel outlet in such a way that the desired fuel-water ratio is set via defined throttle points of a mixer unit. In order to promote a lower pressure gradient with equal mixing function the mixer unit with its throttle points may be in the form of Venturi nozzles.

It is further known for example from DE 10 2006 027 201 A1 to inject the water separated in the fuel filter—including the fuel contained therein—via an injection nozzle into the exhaust gas system of the internal combustion engine. The injection of the water into the exhaust gas system however can lead to thermal problems in the exhaust gas after-treatment process, as the water concentration can fluctuate very greatly and unpredictably in the range from 0 to 100%.

It is the principal object of the present invention to provide an improved fuel supply system with a fuel filter including means for collecting the water separated from the fuel and disposing the water in an environmentally friendly and reliable process.

SUMMARY OF THE INVENTION

In a fuel supply system with a fuel supply pipe for conveying fuel from a fuel tank via a fuel pump and a fuel supply pipe to a fuel injection device of an internal combustion engine, wherein a fuel filter including a water separator is arranged in the fuel supply pipe and is coupled with the fuel filter for removing the water which has collected in the water separator of the fuel filter and injecting it into an exhaust as system of the internal combustion engine, a fuel/water discharge arrangement is provided which includes a main pipe connected to a water-free region of the fuel filter, a branch pipe connected to a water collection region of the fuel filter and a mixing device arranged in the main pipe to which the branch pipe is connected for mixing water to a fuel flow in the main pipe in a controllable manner for injection into the exhaust gas system. The fuel portions present in the water are combusted in this way in the exhaust gas after-treatment system of the internal combustion engine so that it can be ensured that non-combusted fuel is not discharged into the environment.

Through the measures to connect the fuel/water discharge devices via two pipes to the fuel filter, wherein the main pipe conveys fuel and the branch pipe conveys water, the water can be mixed via a mixing device in a controllable manner into the fuel flow to the exhaust gas after-treatment system. It can be ensured in this way that a fuel flow with a water concentration fluctuating between 0% and no more than a defined value of less than 100% is supplied to the fuel/water discharge device and thus to the exhaust gas system. In this way the regulating problems and thermal problems of conventional exhaust gas systems mentioned above are avoided or greatly reduced.

The mixing device is preferably provided with at least one throttle structure or nozzle. The mixing device is in this case formed particularly preferably in the form of a Venturi nozzle device.

According to a preferred embodiment of the invention a valve device is provided in the branch pipe for optional opening or closing of the branch pipe. Through this optionally provided valve device it is possible, for example for flushing processes or regeneration processes, to set the possible maximum water concentration in the fuel flow fed to the fuel/water discharge device to 0%.

This valve device of the branch pipe is preferably arranged in or on a housing of the fuel filter. In this way a compact structural form of the fuel supply system can be achieved.

According to a further embodiment of the invention a dosing device is provided between the mixing device and the fuel/water discharge device.

This dosing device is connected to the mixing device preferably via a short pipe element so that the dosing device can be flushed very quickly, if required—for example with the aid of a shut-off valve in the water supply pipe to the mixing device.

Furthermore a water level sensor can be provided in order to detect a water level in the water separator of the fuel filter. By means of such a water level sensor it can be ensured that the quantity of water which has collected in the fuel filter does not exceed a predefined upper threshold. Furthermore the occurrence of water in the dosing device can be predicted in a substantially improved manner through this measure.

In a particular embodiment of the invention this water level sensor forms a structural unit with the valve device of the branch pipe. This structural unit is additionally arranged preferably in or on a housing of the fuel filter in order to be able to achieve a compact structural form of the fuel supply system.

According to a further embodiment of the invention the mixing device (Venturi) nozzle) is arranged in the fuel filter in a position above the water level. In this way, during the injection pauses (i.e. during pause periods of the dosing device) the water can flow back into the fuel filter or into the water separator thereof. Due to the higher density of the water in comparison with the fuel, and with a subsequent only very short flush dosage this dosing takes place initially with fuel which is then present in the pipe element without water mixed in.

The above as well as further features and advantages of the invention will become more readily apparent form the following description of a preferred, non-limiting exemplary embodiment with reference to the accompanying drawings.

SHORT DESCRIPTION OF THE DRAWING

FIG. 1 shows a schematic illustration of the structure of a fuel supply system according to an exemplary embodiment of the present invention.

DESCRIPTION OF AN EXEMPLARY EMBODIMENT

Fuel is supplied to a fuel injection device 10 of an internal combustion engine (not shown) via a fuel supply pipe 12. The internal combustion engine is for example a diesel engine but the fuel supply system according to the invention is not to be limited to this particular application.

A fuel filter 16 provided with a water separator 17 is arranged in the fuel supply pipe 12 in a manner known per se. The fuel is conveyed by means of a fuel pump 14 arranged upstream of the fuel filter 16 and/or a fuel pump 15 arranged downstream of the fuel filter 16 to the fuel injection device 10 of the internal combustion engine.

In order to detect the quantity of water which has collected in the fuel filter 16, a water level sensor 18 is provided which is preferably incorporated in, or on, the housing of the fuel filter 16.

The inventive concept for automatic removal of the water which has collected in the fuel filter 16 or in the water separator 17 thereof will now be explained in greater detail.

According to the present invention the water which has collected in the fuel filter 16 is removed from the filter and injected into the exhaust gas system 34 of the internal combustion engine so that the non-combusted fuel contained in the water passes through the exhaust gas after-treatment system of the internal combustion engine and is combusted thereby.

For this purpose a branch pipe 20 is connected to the water storage region of the fuel filter 16, i.e. in general a low point of the fuel filter. In addition a main pipe 22 is connected to a higher water-free point of the fuel filter 16 so that through this main pipe 22 only fuel, in particular only purified fuel, is conveyed.

The main pipe 22 and the branch pipe 20 both extend to a Venturi nozzle mixing device 24. This takes place in such a way that the fuel flow of the main pipe 22 flowing through the Venturi nozzle mixing device 24 draws the water in the branch pipe 20 along with it. Depending on the design of the cross-section ratios of the branch pipe 20, main pipe 22 and Venturi nozzle mixing device 24 an essentially constant maximum water mixing ratio to the fuel flow can be set. In particular maximum water mixing with values of less than 100% can be set through the (Venturi nozzle) mixing device 24.

Downstream of the Venturi nozzle mixing device 24 a dosing device 28 is provided in order to adjust the quantity of fuel/water fed to the fuel/water discharge device 32. The Venturi nozzle mixing device 24 is thereby connected to the dosing device 28 by means of a pipe element 26 which is as short as possible and the dosing device 28 is connected to the fuel/water discharge device 32 via a further pipe element 30.

Using an electromagnetic shut-off valve 36 arranged in the branch pipe 20 the water supply flow into the Venturi nozzle mixing device can optionally be enabled or interrupted. Optionally a fuel/water mixture with a fixed set maximum water portion or a pure fuel therefore flows through the dosing device 28. The dosing device 28 can, if required, therefore be flushed very rapidly with pure fuel and at any time it can switch to pure fuel dosing into the exhaust gas system 34 of the internal combustion engine. The flushing of the dosing device 28 can for example be necessary in case of an unexpected engine stop in order that no water remains in the dosing device which could lead to oxidation or icing damage. The injection of pure fuel into the exhaust gas system 34 of the internal combustion engine is desired for example during regeneration processes of the exhaust gas after-treatment system.

The shut-off valve 36 of the branch pipe 20 forms a structural unit for example with the water level sensor 18 of the fuel filter 16. This structural unit is incorporated on or in the housing of the fuel filter 16 in order to achieve a structural form which is as compact as possible.

The position of the Venturi nozzle mixing device 24 is selected to be above the water level in the fuel filter 16. During the dosing pauses, that is when the dosing device 28 is blocked but the shut-off valve 36 is simultaneously opened, or there is no shut-off valve 36, fuel can still flow via the main pipe 22 into the branch pipe 20 to the water separator 17 and replace in the branch pipe the water flowing back into the separator until the water level in the branch pipe 20 is equal to that in the water separator 17. Fuel is thereby present in the front part of the branch pipe 20 without water mixed in, which provides for a desirable short time dosing operation with pure fuel when water mixing is being activated.

What is claimed is:

1. A fuel supply system having a fuel supply pipe (12) with a fuel pump (14, 15) for conveying fuel from a fuel tank via the fuel pump (14, 15) to a fuel injection device (10) of an internal combustion engine; the system further including a fuel filter (16) with a housing arranged in the fuel supply pipe (12) and comprising a water separator (17);

a fuel/water discharge device (32) coupled with the fuel filter (16) for removing water which has collected in the water separator (17) from the fuel filter (16) and inject it into an exhaust gas system (34) of the internal combustion engine, the fuel/water discharge device (32) being connected via a main pipe (22) to a water-free region of the fuel filter (16) and via a branch pipe (20) to a water storage region of the fuel filter (16); and a mixing device (24) arranged in the main pipe (22), and the branch pipe (20) extending to the mixing device (24) so that a fuel flow of the main pipe (22) can draw water via the branch pipe (20) from the water separator (17), the mixing device (24) being in the form of a throttle device, or a venturi nozzle;

a valve device (36) provided in the housing of the fuel filter (16) or the branch pipe (20) for optional opening or closing of the branch pipe (20); and a water level sensor (18) arranged in the water separator (17) of the fuel filter (16) for detecting a water level.

2. The fuel supply system according to claim 1, wherein a dosing device (28) is provided between the mixing device (24) and the fuel/water discharge device (32).

3. The fuel supply system according to claim 2, wherein the dosing device (28) is connected to the mixing device (24) via a short pipe element (26).

4. The fuel supply device according to claim 1, wherein the valve device (36) of the branch pipe (20) and the water level sensor (18) form a structural unit.

5. The fuel supply system according to claim 4, wherein the structural unit comprises the valve device (36) and water level sensor (18) is arranged in or on a housing of the fuel filter (16).

6. The fuel supply system according to claim 1, wherein the mixing device (24) is arranged above a water level in the fuel filter (16).

* * * * *